US010422048B2

(12) United States Patent
Hatchett et al.

(10) Patent No.: US 10,422,048 B2
(45) Date of Patent: Sep. 24, 2019

(54) PROCESSES FOR RECOVERING RARE EARTH ELEMENTS

(71) Applicants: THE BOARD OF REGENTS OF THE NEVADA SYSTEM OF HIGHER EDUCATION on behalf of THE UNIVERSITY OF NEVADA, Las Vegas, NV (US); REACTIVE INNOVATIONS, LLC, Westford, MA (US)

(72) Inventors: David W. Hatchett, Las Vegas, NV (US); Kenneth R. Czerwinski, Seattle, WA (US); Janelle Droessler, Las Vegas, NV (US); Karen D. Jayne, Littleton, MA (US); Michael C. Kimble, Westford, MA (US); Kyle G. Boutin, Westford, MA (US)

(73) Assignees: THE BOARD OF REGENTS OF THE NEVADA SYSTEM OF HIGHER EDUCATION ON BEHALF OF THE UNIVERSITY OF NEVADA, LAS VEGAS, Las Vegas, NV (US); REACTIVE INNOVATIONS, LLC, Westford, MA (US)

( * ) Notice: Subject to any disclaimer, the term of this patent is extended or adjusted under 35 U.S.C. 154(b) by 142 days.

(21) Appl. No.: 15/515,990

(22) PCT Filed: Sep. 30, 2015

(86) PCT No.: PCT/US2015/053323
§ 371 (c)(1),
(2) Date: Mar. 30, 2017

(87) PCT Pub. No.: WO2016/054265
PCT Pub. Date: Apr. 7, 2016

(65) Prior Publication Data
US 2017/0306514 A1 Oct. 26, 2017

Related U.S. Application Data

(60) Provisional application No. 62/057,875, filed on Sep. 30, 2014.

(51) Int. Cl.
*C22B 3/20* (2006.01)
*C25C 1/22* (2006.01)
(Continued)

(52) U.S. Cl.
CPC ..... *C25C 1/22* (2013.01); *C22B 3/20* (2013.01); *C22B 59/00* (2013.01); *C25C 3/34* (2013.01)

(58) Field of Classification Search
CPC ..... C22B 59/00
See application file for complete search history.

(56) References Cited

U.S. PATENT DOCUMENTS 2,446,331 A 8/1948 Hurley
2,446,349 A 8/1948 Wier, Jr. et al.
(Continued)

FOREIGN PATENT DOCUMENTS

JP 2003515667 A 5/2003
JP 2008007801 A 1/2008
WO 2009019147 A2 2/2009

OTHER PUBLICATIONS

International Search Report and Written Opinion for Application No. PCT/US15/53323 dated Feb. 1, 2016 (9 pages).
(Continued)

*Primary Examiner* — Melissa S Swain
(74) *Attorney, Agent, or Firm* — Michael Best & Friedrich LLP

(57) ABSTRACT

A process for recovering a rare earth element. The process includes adding water and a nonaqueous acid to an ionic liquid, and dissolving an oxide of a first rare earth element directly into the ionic liquid to form an ionic solution comprising at least about 0.1 weight percent water, the acid and an ion of the first rare earth element. The process further includes applying a potential to the ionic solution to deposit the first rare earth element onto an electrode as a metal.

21 Claims, 15 Drawing Sheets

(51) Int. Cl.
*C22B 59/00* (2006.01)
*C25C 3/34* (2006.01)

(56) References Cited

U.S. PATENT DOCUMENTS

| | | | |
|---|---|---|---|
| 2,446,350 | A | 8/1948 | Wier, Jr. |
| 2,924,506 | A | 2/1960 | Anderson et al. |
| 3,030,176 | A | 4/1962 | Lyon |
| 4,552,588 | A | 11/1985 | Elliott |
| 4,839,149 | A | 6/1989 | Madic et al. |
| 5,205,999 | A | 4/1993 | Willis et al. |
| 5,582,706 | A | 12/1996 | Grantham et al. |
| 6,233,298 | B1 | 5/2001 | Bowman |
| 6,379,634 | B1 | 4/2002 | Fields et al. |
| 6,911,135 | B1 | 6/2005 | Thied et al. |
| 7,011,736 | B1 | 3/2006 | Miller et al. |
| 7,097,747 | B1 | 8/2006 | Herceg et al. |
| 7,267,754 | B1 | 9/2007 | Willit |
| 2006/0169590 | A1 | 8/2006 | Hebditch et al. |
| 2007/0272557 | A1 | 11/2007 | Matthews |
| 2008/0128284 | A1 | 6/2008 | Penner et al. |
| 2008/0214814 | A1 | 9/2008 | Li et al. |
| 2011/0151607 | A1 | 6/2011 | Landis et al. |
| 2013/0233716 | A1 | 9/2013 | Hatchett et al. |

OTHER PUBLICATIONS

Srncik, M. et al., "Uranium Extraction from Aqueous Solutions by Ionic Liquids", Journal of Applied Radiation and Isotopes, (2009), 67(12), 2146-2149.

Iizuka, M. et al., "Actinides Recovery from Molten Salt/Liquid Metal System by Electrochemical Methods", Journal of Nuclear Materials, (1997), 247, 183-190.

Kim, K. R. et al., "Electro-fluid Analysis of a Molten-salt Electrorefiner with Rotating Cruciform Anode Baskets", I. S. J. Radioanal Nucl Chem, (2010), 286, 801-806.

Koyama, T. et al, "An Experiment Study of Molten Salt Electrorefining of Uranium Using Solid Iron Cathode and Liquid Cadmium Cathode for Development of Pyrometallurgical Reprocessing", Journal of Nuclear Science and Technology, (Apr. 1997), vol. 34 No. 4, 384-393.

Arthur Rose et al., The Condensed Chemical Dictionary, seventh edition, Reinhold Book Corporation, New York, 1968, pp. 701.

EPA, Ozone (03) Standards—Table of Historical Ozone NAAQs.

International Search Report and Written Opinion for Application No. PCT/US2014/015749 dated May 12, 2014 (10 pages).

Beller et al., "Actinide Foil Production for MPACT Research", Project No. 11-3138, Department of Energy, Oct. 30, 2012, 24 pages.

Asanuma et al., "Electrochemical Properties of Uranyl Ion in Ionic Liquids as Media for Pyrochemical Reprocessing", J. Nucl. Sci. Technol., 44(3), pp. 368-372, (2007).

Rao et al., "Dissolution of Uranium Oxides and Electrochemical Behavior of U(VI) in Task Specific Ionic Liquid", Radiochim Acta 96, pp. 403-409, (2008).

"Room Temperature", Hawley's Condensed Chemical Dictionary, p. 1095, (2007).

Bhatt et al., "Cyclic Voltammetry of Th(IV) in the Room-Temperature Ionic Liquid [Me3NnBu] [N(SO2CF3)2]", Inorg. Chem. 45, pp. 1677-1682, (2006).

Pemberton et al., "Electrochemistry of soluble UO2 2+ from the direct dissolution of UO2CO3 in acidic ionic liquid containing water", Electrochimica Acta, 2013, vol. 93, pp. 264-271.

Bhatt et al., "Structural Characterization of a Lanthanum Bistriflimide Compex, La(N(SO2CF3)2)3(H2O)3, and an Investigation of La, Sm, and Eu Electrochemistry in a Room-Temperature Ionic Liquid, [Me3NnBu][N(SO2CF3)2]", Inorg. Chem. 44, pp. 4934-4940, (2005).

Legeai et al., "Room-Temperature Ionic Liquid for Lanthanum Electrodeposition", Electrochem. Comm. 10, pp. 1661-1664, (2008).

Chen et al., "Electrodeposition of Cesium at Mercury Electrodes in the Tri-1-Butylmethylammonium Bis ((trifluoromethyl)sulfonyl)imide Room-Temperature Ionic Liquid", Electrochim. Acta 49, pp. 5125-5138, (2004).

Reddy, R. G. JPED 2006, 27, 210-211.

Cocalia, V. A.; Gutowski, K. E.; Rogers, R. D. Coordination Chemistry Reviews 2006, 250, 755-764.

Earle, M. J.; Seddon, K. R. Pure and Applied Chemistry 2000, 72, 1391-1398.

Buzzeo, M. C.; Evans, R. G.; Compton, R. G. ChemPhysChem 2004, 5.

Extended European Search Report from the European Patent Office for Application No. 14749320.9 dated Aug. 9, 2016 (9 pages).

Standard Electrode Reduction and Oxidation Potential Values, (1 page).

Office Action from the US Patent and Trademark Office for U.S. Appl. No. 13/764,282 dated Oct. 1, 2013 (9 pages).

Final Office Action from the US Patent Office for U.S. Appl. No. 13/764,282 dated Apr. 24, 2014 (13 pages).

Office Action from the US Patent and Trademark Office for U.S. Appl. No. 13/764,282 dated Oct. 8, 2014 (14 pages).

Office Action from the US Patent and Trademark Office for U.S. Appl. No. 13/764,282 dated Mar. 26, 2015 (16 pages).

Office Action from the US Patent and Trademark Office for U.S. Appl. No. 13/764,282 dated Nov. 18, 2015 (19 pages).

Notice of Allowance from the US Patent and Trademark Office for U.S. Appl. No. 13/764,282 dated Aug. 24, 2016 (9 pages).

Notice of Allowance from the US Patent and Trademark Office for U.S. Appl. No. 13/764,282 dated Dec. 16, 2016 (5 pages).

Office Action from the US Patent and Trademark Office for U.S. Appl. No. 13/268,138 dated Oct. 1, 2013 (11 pages).

Final Office Action from the US Patent Office for U.S. Appl. No. 13/268,138 dated May 8, 2014 (13 pages).

Office Action from the US Patent and Trademark Office for U.S. Appl. No. 13/268,138 dated Jul. 20, 2015 (23 pages).

Final Office Action from the US Patent Office for U.S. Appl. No. 13/268,138 dated Apr. 28, 2016 (15 pages).

Beller, Denis D., "Actinide Foil Production for MPACT Research," U.S. Department of Energy NEUP Technical Report, 2012, University of Nevada, Las Vegas, NV, (25 pages).

Office Action with English translation from the Japanese Patent Office for Application No. 2015-557194 dated May 7, 2018 (10 pages).

International Preliminary Report on Patentability for Application No. PCT/US2015/053323 dated Apr. 13, 2017 (7 pages).

PROCESSES FOR RECOVERING RARE EARTH ELEMENTS

CROSS REFERENCE TO RELATED APPLICATION(S)

This is a U.S. national stage entry of International Patent Application No. PCT/US2015/053323, filed on Sep. 30, 2015, which claims priority to U.S. Provisional Patent Application No. 62/057,875, filed on Sep. 30, 2014, the entire contents of all of which are fully incorporated herein by reference.

STATEMENT AS TO FEDERALLY SPONSORED RESEARCH

This invention was made with government support under grant O12B-T02-4109 awarded by the OSD/NAVY. The government has certain rights in this invention.

TECHNICAL FIELD

This disclosure provides processes for recovering rare earth elements, which also may separate rare earth elements from each other.

BACKGROUND

A rare earth element is one of a set of seventeen chemical elements in the periodic table, specifically the fifteen lanthanides (having atomic numbers from 57 to 71) plus scandium (atomic number 21) and yttrium (atomic number 39). Rare earth elements are valued for their unique magnetic, optical and catalytic properties, and are used in many technologies including wind turbines, electric vehicles, photovoltaic thin films and fluorescent lighting. Although rare earth elements are fairly abundant in the Earth's crust, rare earth elements are typically dispersed and not often found concentrated as rare earth minerals in economically exploitable ore deposits. The traditional method of extracting rare earth elements from ore is the solvent-exchange method, and consists of first crushing the rock into smaller chunks and then grinding it into a fine dust. Unwanted materials (largely iron oxide minerals and carbonate minerals) are removed using various separation methods, leaving behind an ore of rare earth elements and radioactive material, which are then separated by various chemical leaching processes. These methods are costly, energy intensive, and can produce significant quantities of waste products. Accordingly, there is a need for more rapid, flexible, efficient, and environmentally-friendly extraction and separations processes.

SUMMARY

This disclosure provides processes for recovering rare earth elements, such as lanthanides. The processes may include adding water and a nonaqueous acid to an ionic liquid, and dissolving an oxide of a first rare earth element directly into the ionic liquid to form an ionic solution comprising at least about 0.1 weight percent water the acid and an ion of the first rare earth element. The processes further may include applying a potential to the ionic solution to deposit the first rare earth element onto an electrode as a metal. The applied potential may be pulsed or constant.

In some cases, the oxide of the first rare earth element may be added to the ionic liquid, prior to adding the water and the nonaqueous acid to the ionic liquid, to form a mixture of the oxide of the first rare earth element and the ionic liquid. In some cases, the ionic solution may be maintained at a temperature of 30° C. or less during application of the potential.

Multiple rare earth element oxides may be dissolved into the ionic liquid. Specifically, the process may include dissolving an oxide of a second rare earth element directly into the ionic liquid, wherein the ionic solution further comprises an ion of the second rare earth element. In such cases, a potential may be applied to the ionic solution so as to preferentially reduce either the ion of the first rare earth element or the ion of the second rare earth metal. For example, the potential applied to the ionic solution may be selected to reduce the ion of the first rare earth element preferentially over the ion of the second rare earth element in the ionic solution. The oxides of the first and second rare earth elements may be obtained from any source material, including a mined or a recycled material.

In some cases, the ionic liquid may comprise one or more room temperature ionic liquids. In some cases, the ionic liquid may comprise an anion selected from an n-Bis(trifluoromethanesulfonylimide) (TFSI) anion, a triflate anion, and a dicyanamide anion. In some cases, the ionic liquid may comprise a cation selected from a tertraalkylammonium cation, a dialkylpyrrolidinium cation, a dialkylpiperidinium cation, a tetraalkylphosphonium cation and a trialkylsulfonium cation.

In some cases, the ionic solution may be saturated with water. In some cases, after adding water, at least some of the water may be removed from the ionic liquid by degassing, by using a molecular sieve, or a combination thereof.

The nonaqueous acid may include a proton and an anion, where the anion of the nonaqueous acid is the same as the anion of the ionic liquid. In some cases, the nonaqueous acid may be selected from n-Bis(trifluoromethanesulfonylimide) acid (HTFSI), triflic acid and dicyanamide acid.

The details of one or more embodiments are set forth in the accompanying description below. Other features and advantages will be apparent from the description, drawings, and the claims.

DESCRIPTION OF DRAWINGS

FIG. 1A is an SEM micrograph of the deposited La. FIG. 1B is an EDS bulk analysis. FIG. 1C is an EDS spot analysis.

FIG. 2A is an SEM micrograph of the deposited La. FIG. 2B is an EDS bulk analysis. FIG. 2C is an EDS spot analysis.

FIG. 3A is an SEM micrograph of the deposited La. FIG. 3B is an EDS bulk analysis. FIG. 3C is an EDS spot analysis.

FIG. 4A is a cyclic voltammogram for $La_2O_3$ in $[Me_3NBu][Tf_2N]$. FIG. 4B is an optical microscope photograph of La deposits on grafoil at −2.5 V versus Ag/Ag+. FIG. 4C is an optical microscope photograph of La deposits on grafoil at −1.9 V versus Ag/Ag+. FIG. 4D is an optical microscope photograph of La deposits on grafoil at −0.57 V versus Ag/Ag+.

FIG. 5A is an SEM micrograph of the deposited La and Pr. FIG. 5B is an EDS analysis of rare earth deposits.

DETAILED DESCRIPTION

Figure 1A:
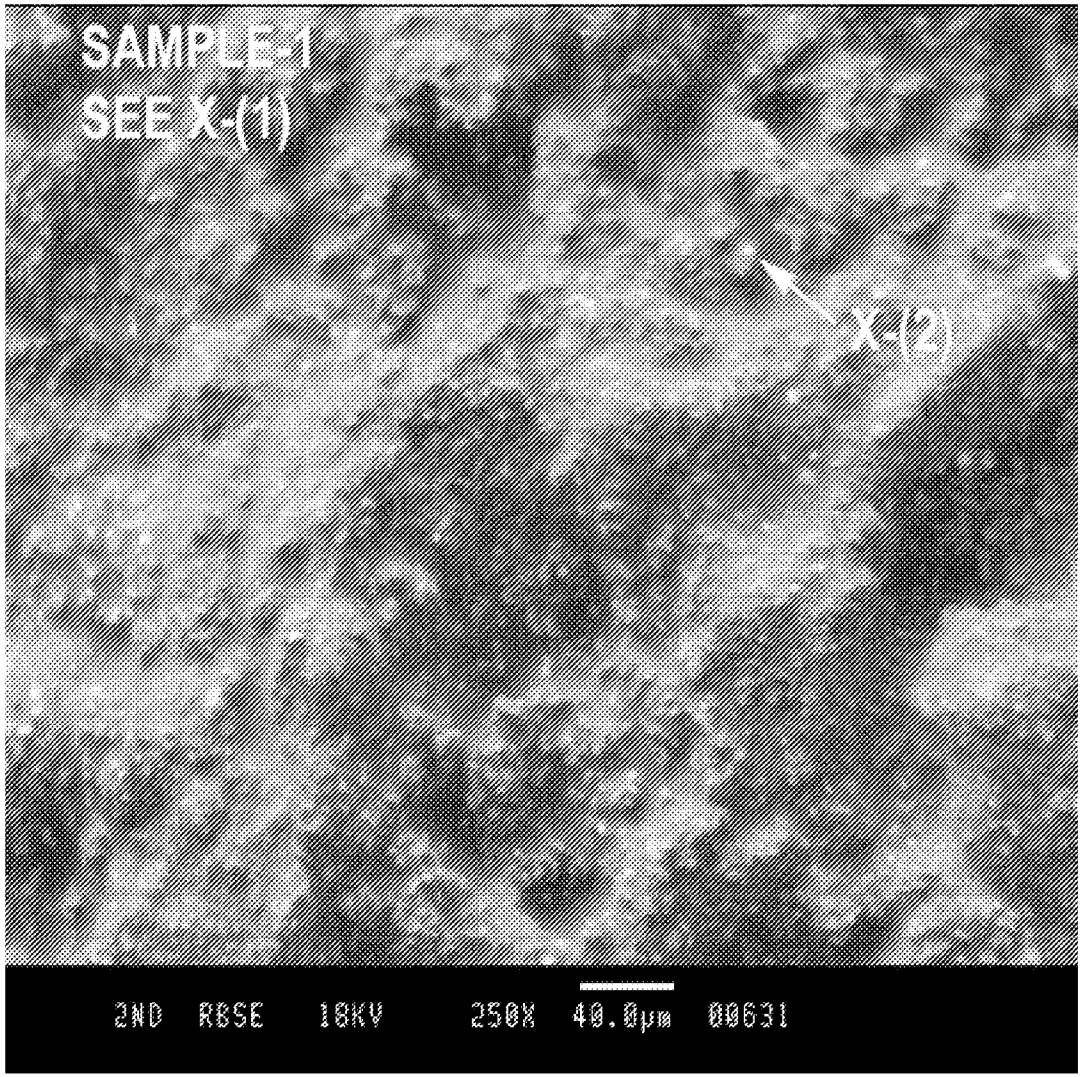
FIGS. 1A-1C depict an exemplary deposition of La at −2.5 V.

The present disclosure is not limited in its application to the specific details of construction, arrangement of components, or method steps set forth herein. The methods disclosed herein are capable of being practiced, used and/or carried out in various ways. The phraseology and terminology used herein is for the purpose of description only and should not be regarded as limiting. Ordinal indicators, such as first, second, and third, as used in the description and the claims to refer to various structures, are not meant to be construed to indicate any specific structures, or any particular order or configuration to such structures or steps. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification, and no structures shown in the drawings, should be construed as indicating that any non-claimed element is essential to the practice of the invention. The use herein of the terms "including," "comprising," or "having," and variations thereof, is meant to encompass the items listed thereafter and equivalents thereof, as well as additional items.

Recitation of ranges of values herein are merely intended to serve as a shorthand method of referring individually to each separate value falling within the range, unless otherwise indicated herein, and each separate value is incorporated into the specification as if it were individually recited herein. For example, if a concentration range is stated as 1% to 50%, it is intended that values such as 2% to 40%, 10% to 30%, or 1% to 3%, etc., are expressly enumerated in this specification. These are only examples of what is specifically intended, and all possible combinations of numerical values between and including the lowest value and the highest value enumerated are to be considered to be expressly stated in this application. Use of the word "about" to describe a particular recited amount or range of amounts is meant to indicate that values very near to the recited amount are included in that amount, such as values that could or naturally would be accounted for due to manufacturing tolerances, instrument and human error in forming measurements, and the like.

No admission is made that any reference, including any non-patent or patent document cited in this specification, constitutes prior art. In particular, it will be understood that, unless otherwise stated, reference to any document herein does not constitute an admission that any of these documents forms part of the common general knowledge in the art in the United States or in any other country. Any discussion of the references states what their authors assert, and the applicant reserves the right to challenge the accuracy and pertinency of any of the documents cited herein. All references cited herein are fully incorporated by reference, unless explicitly indicated otherwise. The present disclosure shall control in the event there are any disparities. No admission is made that any reference, including any non-patent or patent document cited in this specification, constitutes prior art. In particular, it will be understood that, unless otherwise stated, reference to any document herein does not constitute an admission that any of these documents forms part of the common general knowledge in the art in the United States or in any other country. Any discussion of the references states what their authors assert, and the applicant reserves the right to challenge the accuracy and pertinency of any of the documents cited herein. All references cited herein are fully incorporated by reference, unless explicitly indicated otherwise. The present disclosure shall control in the event there are any disparities.

This disclosure provides processes for recovering rare earth elements from oxides of rare earth elements, such as may be found in compositions such as mined ores or recycled materials. These processes exploit the unique solvating capability of ionic liquids to dissolve stoichiometric amounts of rare earth element oxides. From the resulting ionic solution, bulk rare earth element metals may be electrochemically deposited onto an electrode from an ionic solution. As discussed above, rare earth elements include the fifteen lanthanides, plus scandium and yttrium. The processes provided herein generally comprise adding water and a nonaqueous acid to an ionic liquid, and dissolving an oxide of a first rare earth element directly into the ionic liquid to form an ionic solution comprising at least about 0.1 weight percent water the acid and an ion of the first rare earth element, and then applying a potential —such as a pulsed or a constant potential—to the ionic solution to deposit the first rare earth element onto an electrode as a metal. This process contrasts significantly with previously demonstrated anodic oxidation of lanthanide metals or aqueous dissolution using acids (e.g., HCL, HNO3, etc.), which are substantially more costly and energy intensive, and may lead to contamination of the deposited metal.

In some cases, the oxide of the first rare earth element may be added to the ionic liquid, prior to adding the water and the nonaqueous acid to the ionic liquid, to form a mixture of the oxide of the first rare earth element and the ionic liquid. In some cases, the ionic solution may be maintained at a temperature of 30° C. or less during application of the potential. In other cases, the oxide of the first rare earth element may be added to the ionic liquid after adding the water and/or nonaqueous acid.

Costly, Energy Intensive, and can Produce Significant Quantities of Waste Products Multiple rare earth element oxides may be dissolved into the ionic liquid, such as by dissolving an oxide of a second rare earth element directly into the ionic liquid such that the ionic solution further comprises an ion of the second rare earth element. In such cases, a potential may be applied to the ionic solution so as to preferentially reduce either the ion of the first rare earth element or the ion of the second rare earth metal. For example, the potential applied to the ionic solution may be selected to reduce the ion of the first rare earth element preferentially over the ion of the second rare earth element in the ionic solution.

Ionic Liquids

An ionic liquid (IL) is a salt in the liquid state. While ordinary liquids such as water and gasoline are predominantly made of electrically neutral molecules, ionic liquids are largely made of ions and ion pairs (i.e., cations and anions), and have physical properties that vary with the identity of the cation/anion species. Any salt that melts without decomposing or vaporizing can usually yield an ionic liquid. Sodium chloride (NaCl), for example, melts at 801° C. (1,474° F.) into a liquid that consists largely of sodium cations ($Na^+$) and chloride anions ($Cl^-$).

The ionic liquids used in the processes of the present disclosure may be liquids at a temperature of less than about 100° C. (212° F.), such as at room temperature. The large potential window of ionic liquid solutions, especially room temperature ionic liquid (RTIL) solutions, is useful for electrochemical reduction of oxidized rare earth elements, they have negligible vapor pressures, and are stable chemically even at elevated temperatures. (Reddy, R. G. JPED 2006, 27, 210-211. Cocalia, V. A.; Gutowski, K. E.; Rogers, R. D. Coordination Chemistry Reviews 2006, 250, 755-764. Earle, M. J.; Seddon, K. R. Pure and Applied Chemistry 2000, 72, 1391-1398.). Finally the thermodynamic driving force for the reduction of the species can be controlled precisely minimizing side reactions. For example, the electrochemical reactions in RTIL can be conducted at room temperature or moderately elevated temperatures in the range of 30-200° C. without significant degradation of the ionic solvent. Ionic liquids free of molecular solvents were first disclosed by Hurley and Wier in a series of U.S. Pat. Nos. (2,446,331, 2,446,349, 2,446,350, the complete disclosures of which are hereby incorporated in their entireties for all purposes). Common features of ionic liquids include a near zero vapor pressure at room temperature, a high solvation capacity and a large liquid range (for instance, of the order of 300° C.). Known ionic liquids include aluminum (III) chloride in combination with an imidazolium halide, a pyridinium halide or a phosphonium halide. Examples include 1-ethyl-3-methylimidazolium chloride, N-butylpyridinium chloride and tetrabutylphosphonium chloride. An example of a known ionic liquid system is a mixture of 1-ethyl-3-methylimidazolium chloride and aluminum (III) chloride.

In some cases, processes provided herein can combine rare earth element oxides with a RTIL having an asymmetric organic cation and a large anion that can both be varied to influence the solution properties including solubility, viscosity, and the overall potential window for electrochemical experiments. (Earle, M. J.; Seddon, K. R. Pure and Applied Chemistry 2000, 72, 1391-1398. Buzzeo, M. C.; Evans, R. G.; Compton, R. G. Chem Phys Chem 2004, 5). For example, ionic liquid may comprise an anion selected from an n-Bis(trifluoromethanesulfonylimide) (TFSI), a triflate anion, and a dicyanamide anion. The cation may be selected from a tertraalkylammonium cation (such as trimethyl-n-butyl ammonium), a dialkylpyrrolidinium cation, a dialkylpiperidinium cation, a tetraalkylphosphonium cation and a trialkylsulfonium cation. For example, in some processes, the anion may be TFSI and thee cation may be trimethyl-n-butyl amine, which allows for a low melting point liquid with high ionic conductivity. In addition, the potential window for this solvent system is on the order of six volts encompassing negative potentials for the electrochemical reduction of solubilized lanthanide ions to metal. Solubility can be an issue when trying to introduce species into the RTIL. While solubility can be influenced using different combinations of cation/anion pairs, the combinatorial approach required to identify the RTIL species is not feasible due to the sheer magnitude of pairs that exist and the inherent cost. Therefore, the direct dissolution of oxides and formation of complexes with anions in the ionic liquid were specifically targeted to enhance solubility of the species in RTIL.

Sources of Rare Earth Element Salts

Rare earth element ore can include both rare earth metals (i.e., rare earth elements in metallic form) and rare earth element salts (e.g., oxides, chlorides, carbonates, etc. or rare earth elements). Rare earth element ore further includes a variety of different rare earth elements. In some cases, processes provided herein can be part of a mining operation to recover rare earth metals from rare earth element ore. Due to the relatively gradual decrease in ionic size with increasing atomic number, the rare earth elements have been difficult to separate. Even with eons of geological time, geochemical separation of the lanthanides has only rarely progressed much farther than a broad separation between light versus heavy lanthanides, otherwise known as the cerium and yttrium earths. Rare earth minerals, as found, usually are dominated by one group or the other. Minerals containing yttrium earth elements include gadolinite, xenotime, samarskite, euxenite, fergusonite, yttrotantalite, yttrotungstite, yttrofluorite (a variety of fluorite), thalenite, and yttrialite. Minerals containing cerium earth elements and the light lanthanides include bastnäsite, monazite, allanite, loparite, ancylite, parisite, lanthanite, chevkinite, cerite, stillwellite, britholite, fluocerite, and cerianite. Monazite, bastnäsite , and loparite have been the principal ores of cerium and the light lanthanides used to recover rare earth metals. Rare earth elements can be used in a variety of products, which can be recycled to recover earth metals using process provided herein.

Dissolving Rare Earth Oxides in Ionic Liquids

In some cases, materials including one or more rare earth element oxides may be ground and mixed with an ionic liquid under conditions that solvate the rare earth elements to form an ionic solution including rare earth element ions. To achieve sufficient dissolution of rare earth element oxides, we discovered that water and a nonaqueous acid may first be combined with the ionic liquid, either prior to or during addition of the rare earth element oxide to the ionic liquid. Addition of water creates water microenvironments within the ionic liquid. Nonaqueous acidic species (e.g. bis-trifluorosulfonylamide acid (HTFSI) and triflic acid) may then be directly dissolved into the ionic liquid, where a significant portion of the acid remains undissociated in the ionic liquid and a smaller amount dissociates into the water microenvironments. The dissolved acid in the water microenvironments initiates the dissolution of the rare earth element oxide in the ionic liquid. Non-aqueous acid species from the ionic liquid continue to move into the aqueous microenvironments as the aqueous acid species within the microenvironments are depleted. This process occurs until all acid is depleted from the ionic liquid or the rare earth metal oxide is fully dissolved. In this manner, it was found that unexpectedly high concentrations of soluble rare earth element ions may be obtained in the ionic solution. In some cases, excess acid may then be neutralized, water may be removed from the ionic liquid, and the rare earth element ions may be electrochemically reduced so as to deposit the rare earth element as a metal on an electrode. Furthermore, these methods may be used to produce a solution containing a mixture of soluble lanthanide ions which, can then be electrochemically separated as metallic deposits.

During dissolution of a rare earth metal oxide into the ionic liquid, the ionic solution may include at least about 0.1 weight percent water and may in some cases be saturated with water. For example, the ionic solution may include at least about 0.2 weight percent, at least about 0.3 weight percent, at least about 0.4 weight percent, at least about 0.5 weight percent, at least about 0.6 weight percent, at least about 0.7 weight percent, at least about 0.8 weight percent, at least about 0.9 weight percent, at least about 1.0 weight percent, at least about 2.0 weight percent, at least about 3.0 weight percent, or at least about 4.0 weight percent water. A saturated ionic liquid may be observed when a double layer of liquid is observed. Water added to the ionic solution to facilitate direct dissolution of a rare earth element oxide into the ionic liquid may be removed from the ionic solution prior to electrochemical deposition of the rare earth metal.

For example, water may be removed from the ionic solution using degassing (e.g., using a nitrogen purge) and/or molecular sieves. The low volatility of a particular ionic liquids may ensure that the total volume remains constant after purging.

The nonaqueous acid added to the ionic liquid may include a proton and an anion, where the anion of the nonaqueous acid is the same as the anion of the ionic liquid. In some cases, the nonaqueous acid may be selected from n-Bis(trifluoromethanesulfonylimide) acid (HTFSI), triflic acid and dicyanamide acid. Increasing the amount of water in the ionic solution may enhance the proton dissociation of the nonaqueous acid and the acid strength, thereby increasing the solubility of a rare earth element oxide into the ionic liquid. In some cases, acid added to the ionic solution may be neutralized prior to the deposition of the rare earth metal. For example, acid can be neutralized using aqueous bases (e.g., ammonium hydroxide).

In some cases, the ionic liquid may be maintained at a temperature of 30° C. or less during the process of dissolving the one or more rare earth element salts.

These improved processes for dissolving rare earth element oxides into ionic liquids substantially increased the molar concentrations of rare earth element ions that could be achieved in an ionic solution. In some cases, methods provided herein produced concentrations of at least 0.05 moles/L of rare earth element ions dissolved in an ionic liquid, such as concentrations of at least 0.1 moles/L, and in some cases, concentrations of at least 0.15 moles/L.

Recovering and Separating Rare Earth Metals from Ionic Liquid

One or more rare earth species may be removed from the ionic solution and deposited as a metal onto an electrode by applying a potential to the ionic solution. As shown below, the applied potential may be selected to preferentially reduce and deposit one or more soluble rare earth element ions from the ionic solution onto an electrode as a metal. In some cases, the applied potential may be constant. In some cases, different rare earth metals in a single ionic solution can be separated from each other by first reducing and depositing the first rare earth species to remove those ions from the solution followed by reducing and depositing a second rare earth on a second electrode by applying a different electric potential. In some cases, processes provided herein can have a selective deposition or multiple species deposition. Processes provided herein enable users to control the deposition of multiple species and thus control over the co-deposition of species with desired concentrations. In some cases, the applied potential may be varied to create desired concentration gradients in a deposit including multiple rare earth metals. In some cases, the applied potential may be pulsed to achieve different molar ratios and/or morphology differences. In some cases, the ionic solution may be maintained at a temperature of 30° C. or less during application of the potential.

EXAMPLES

The following data demonstrates who potentials can be varied to achieve deposits of rare earth metals having desired concentrations of different rare earth metals.

The following series of rare earth element oxides were dissolved into the ionic liquid (IL), N-trimethyl-N-butylammonium bis(trifluoromethanesulfonyl)imide, ([Me3NnBu][TFSI]). In all cases, the ionic liquids were saturated with water (i.e., water was added until a double layer of liquid was observed). The visible double layer of water was decanted with a pipette. Enough ground rare earth metal oxide was weighed, such that if the rare earth element were completely dissolved into the ionic liquid, it would form a concentration of 0.15M. The rare earth metal oxide was then added to the ionic liquid to form a mixture. It was observed that the rare earth metal oxide did not completely dissolve into the ionic liquid. A stoichiometric amount of nonaqueous acid (HTFSI) was then added to the ionic liquid, and it was observed that all of the rare earth element oxide was then dissolved into the ionic liquid. After everything was dissolved, we neutralized any remaining acid with ammonium hydroxide, and water was removed by purging and/or by using molecular sieves. Electrochemical plating was conducted on these resultant solutions, as shown in the table below.

TABLE 1

Rare Earth Oxide Solution composition in ionic liquid (IL)

| Species | Symbol | Formula | Molecular Weight (g/mol) | final concentration |
|---|---|---|---|---|
| Lanthanum | La | $La_2O_3$ | 325.82 | 0.15 |
| Cerium | Ce | $CeO_2$ | 172.12 | 0.15 |
| Neodymium | Nd | $Nd_2O_3$ | 336.48 | 0.15 |
| Samarium | Sm | $Sm_2O_3$ | 348.7 | 0.15 |
| Praseodymium | Pr | $Pr_2O_3$ | 329.83 | 0.15 |

All of the cyclic voltammetry and the electrodeposition of the individual rare earth species was achieved from the ionic solutions in Table 1. The deposition of rare earth species on a grafoil substrate was achieved at constant potential. The deposition was also achieved using cyclic voltammetry.

Figure 4A:
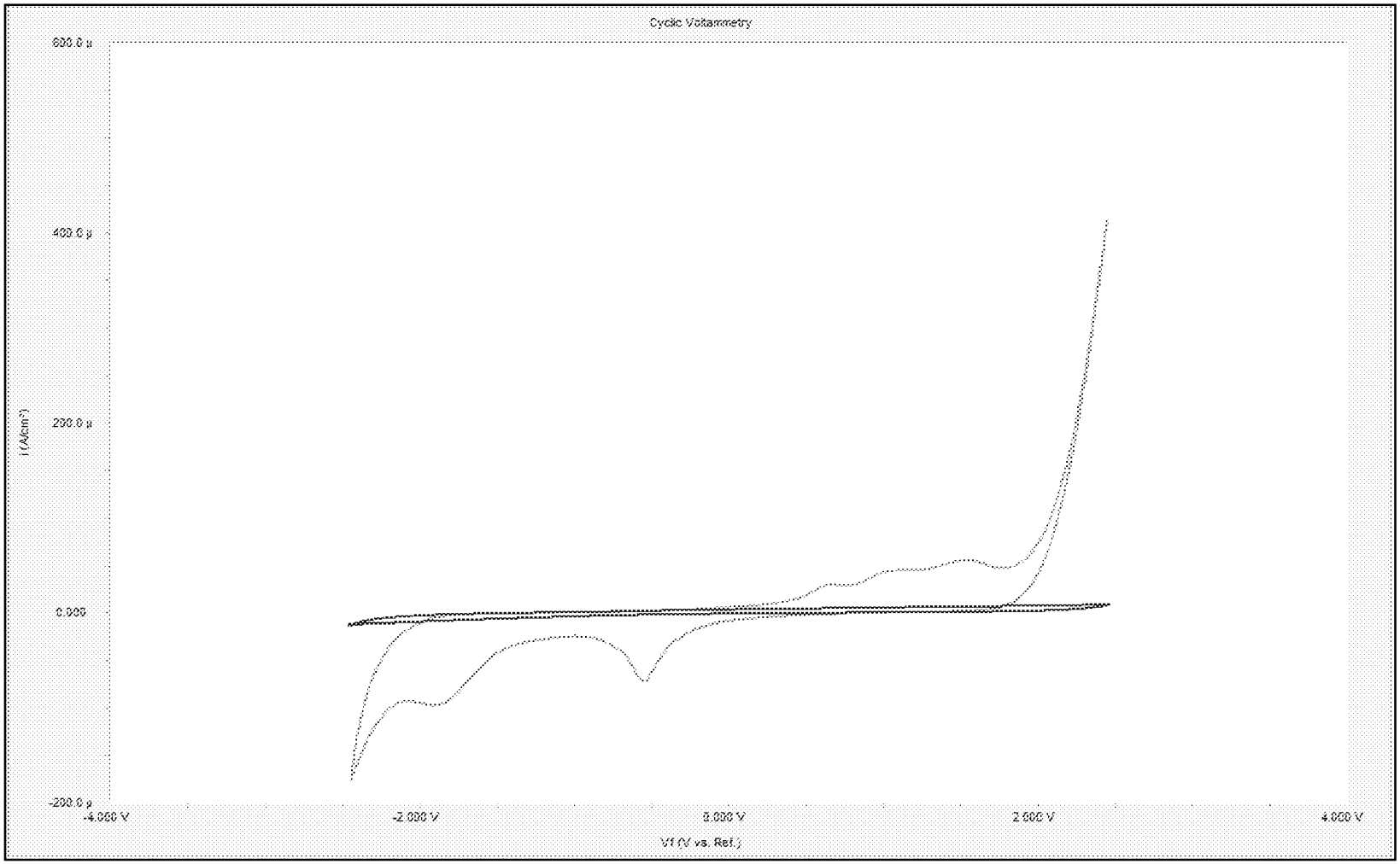
FIGS. 4A-4D depict how different potentials impact the deposition of La from $La_2O_3$ in the ionic salt $[Me_3NBu][Tf_2N]$.

The cyclic voltammogram for $La_2O_3$ dissolved in an ionic liquid is provided with the baseline ionic liquid in FIG. 4A. In the rare earth-ionic liquid system multiple reduction peaks and oxidation peaks were observed. Using this cyclic voltammogram, we selected several reduction potentials (2.5, 1.9, 1.5 V) and performed electrodeposition experiments onto grafoil working electrodes using the same solution. Although only La is discussed in the disclosure similar results were obtained for Ce, Nd, Sm, and Pr (not shown) and metal deposition was achieved for all five rare-earth species studied.

Figure 4B:
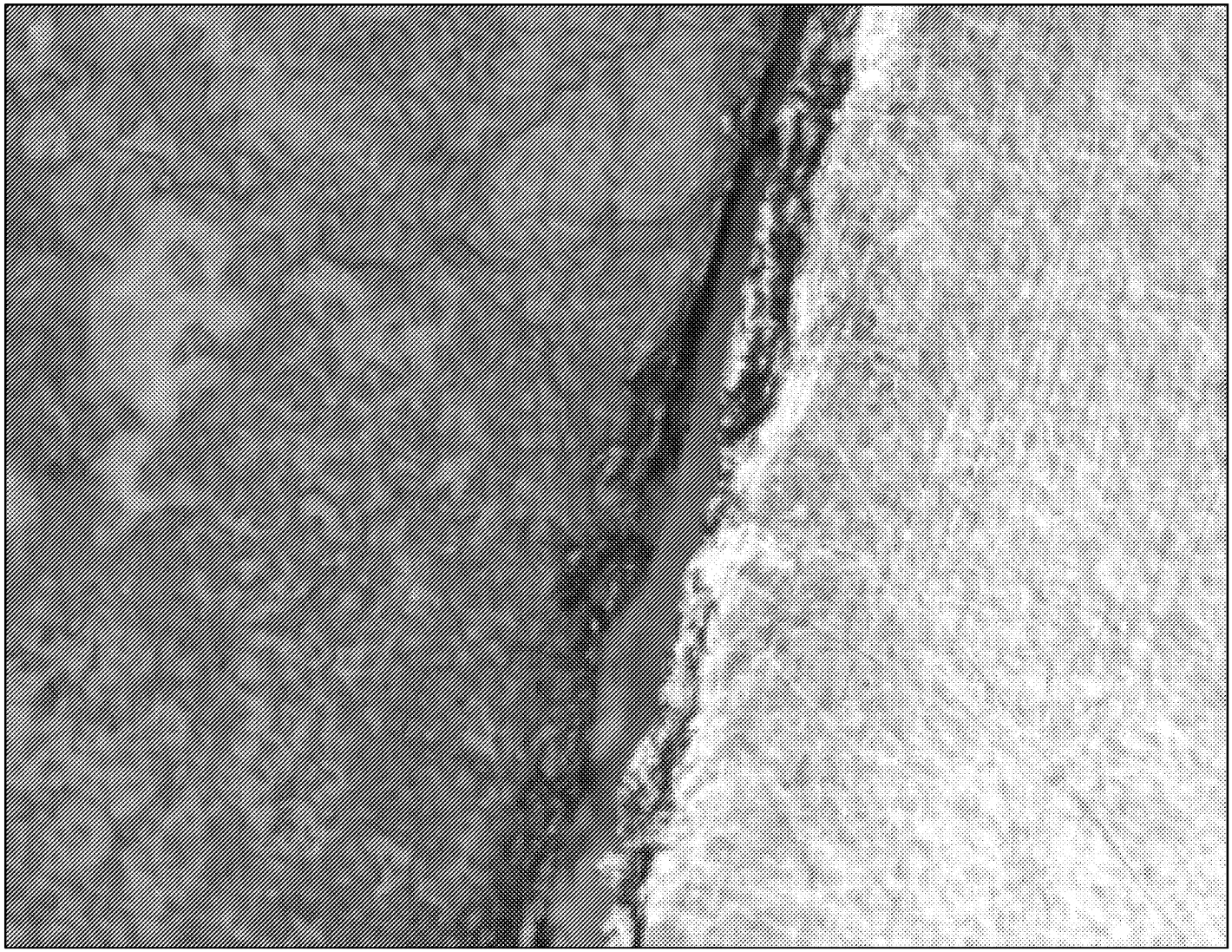
Figure 4C:
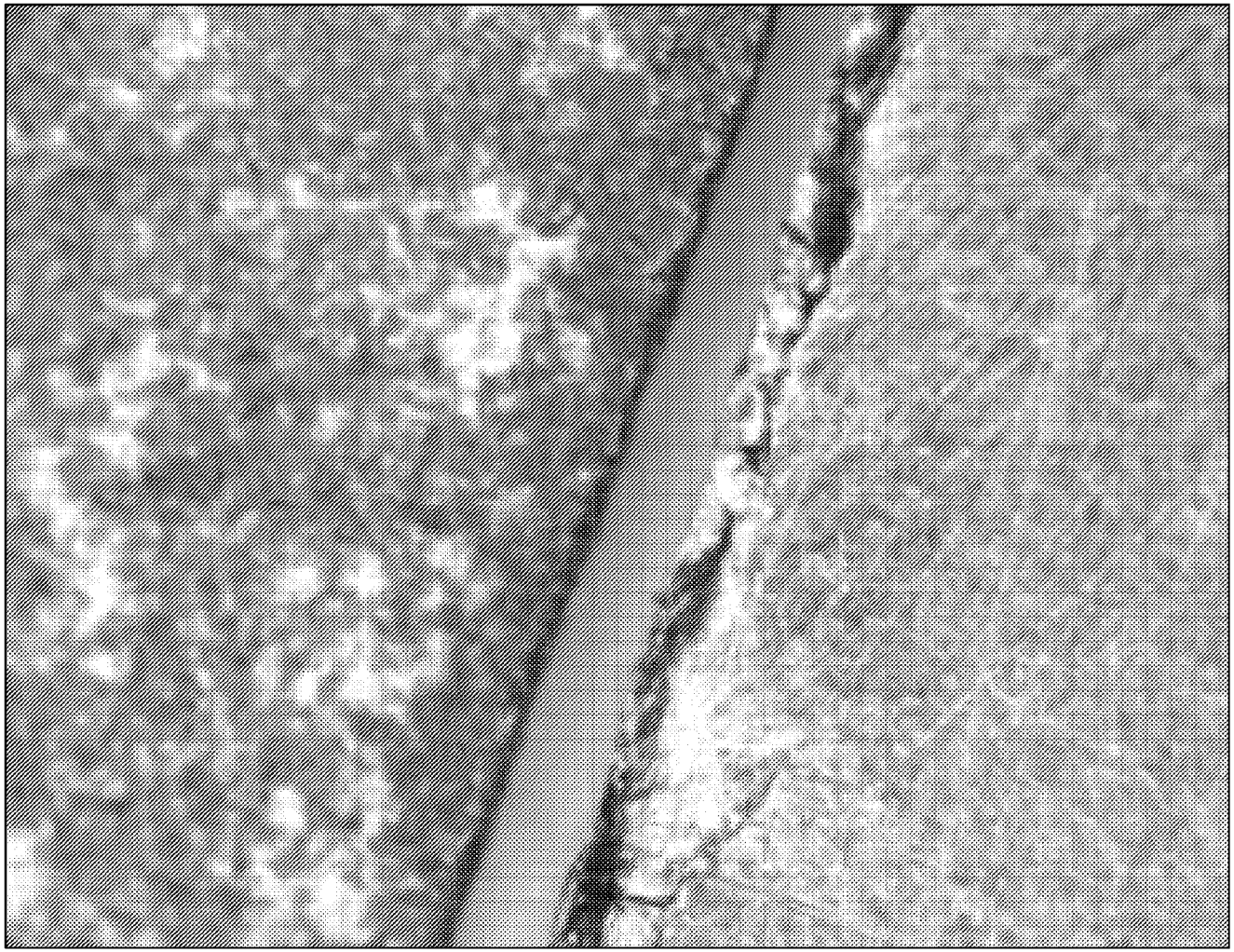
Figure 4D:
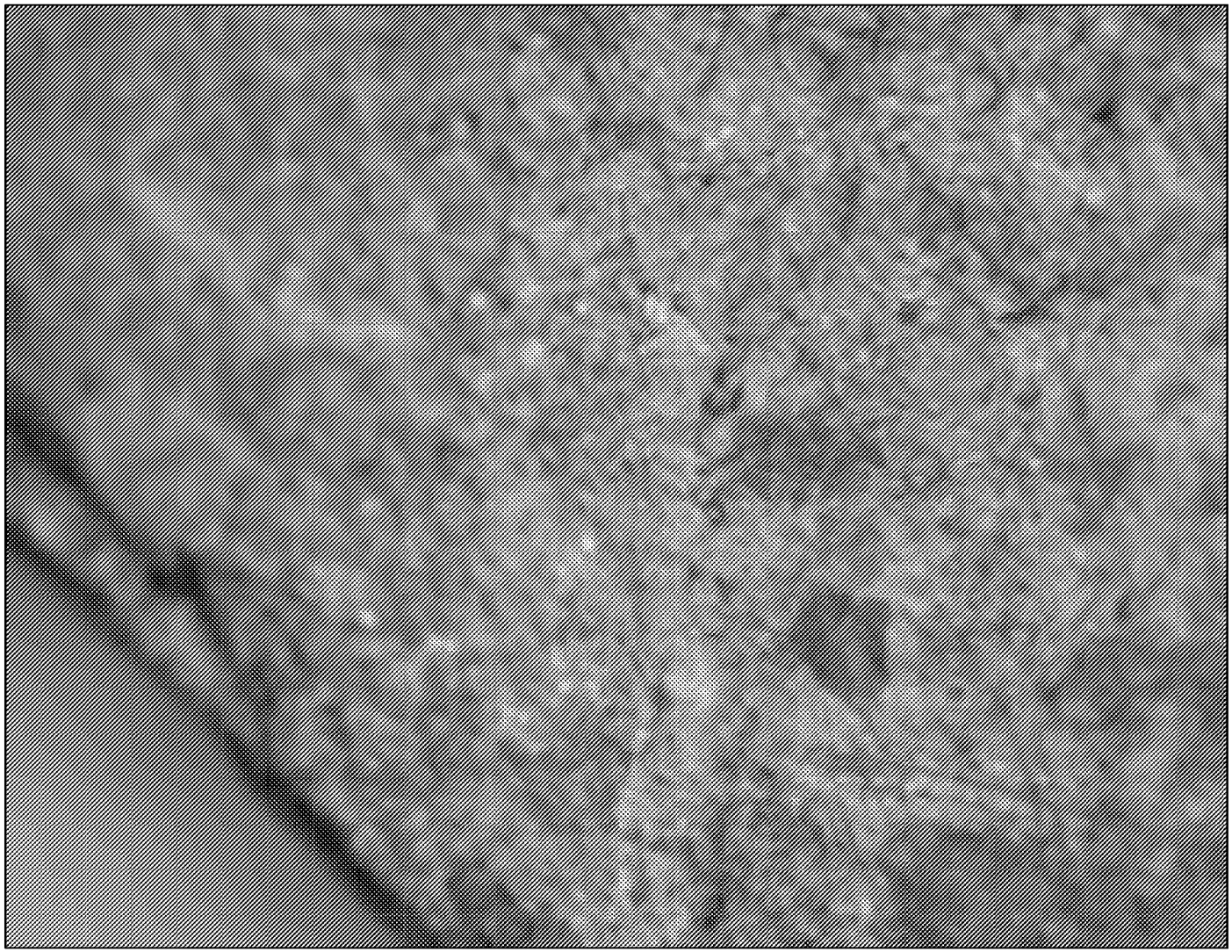

The grafoil substrates were held at constant potential for 600 seconds. The deposition was achieved without stirring and therefore is diffusion limited. Stirring can be utilized to achieve convection and increase the rated of deposition. Individual grafoil electrode with La deposits were rinsed in ethanol and imaged (FIGS. 4B-4D) using a scanning electron microscope with bulk deposition observed at each voltage.

Figure 1B:
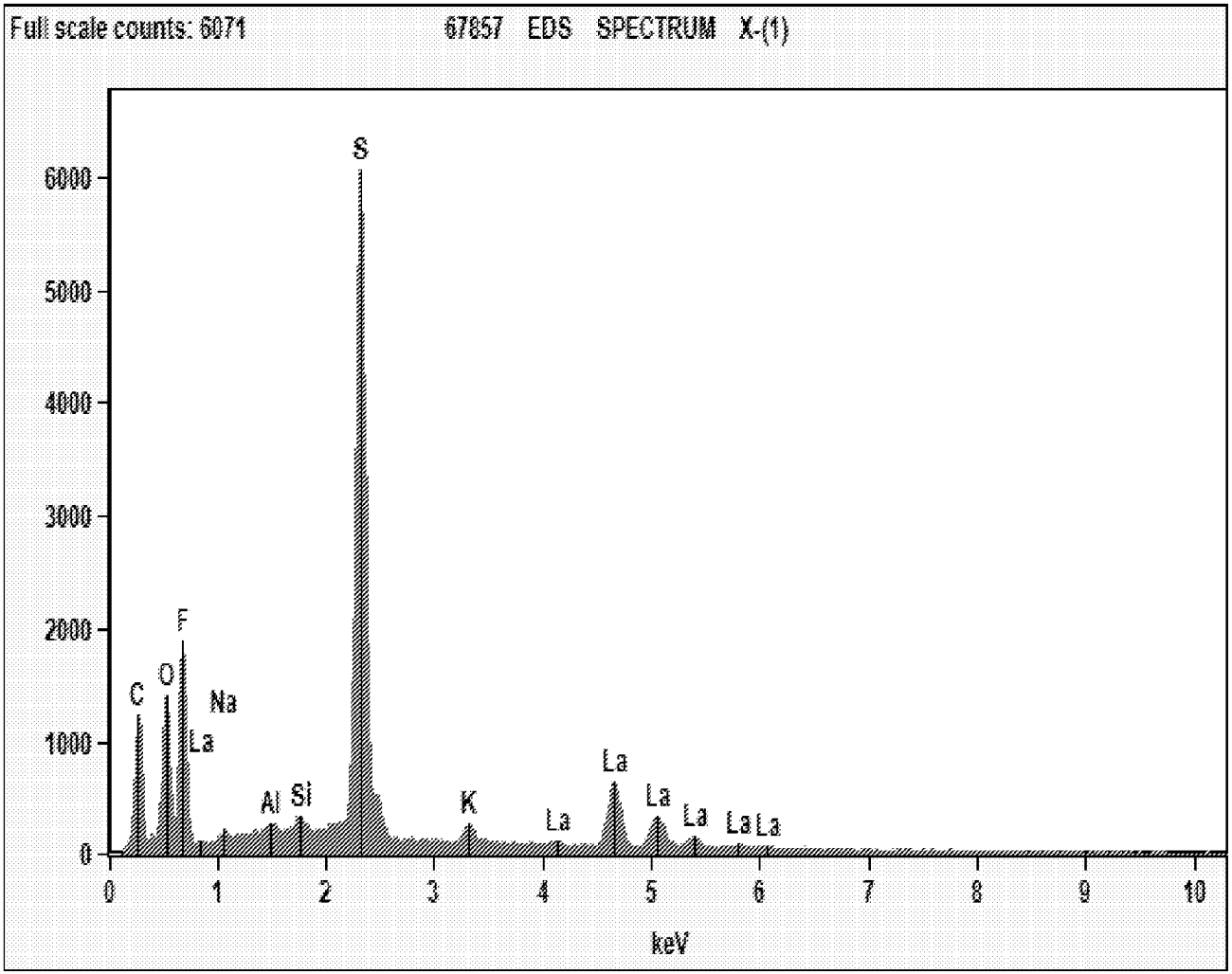
Figure 1C:
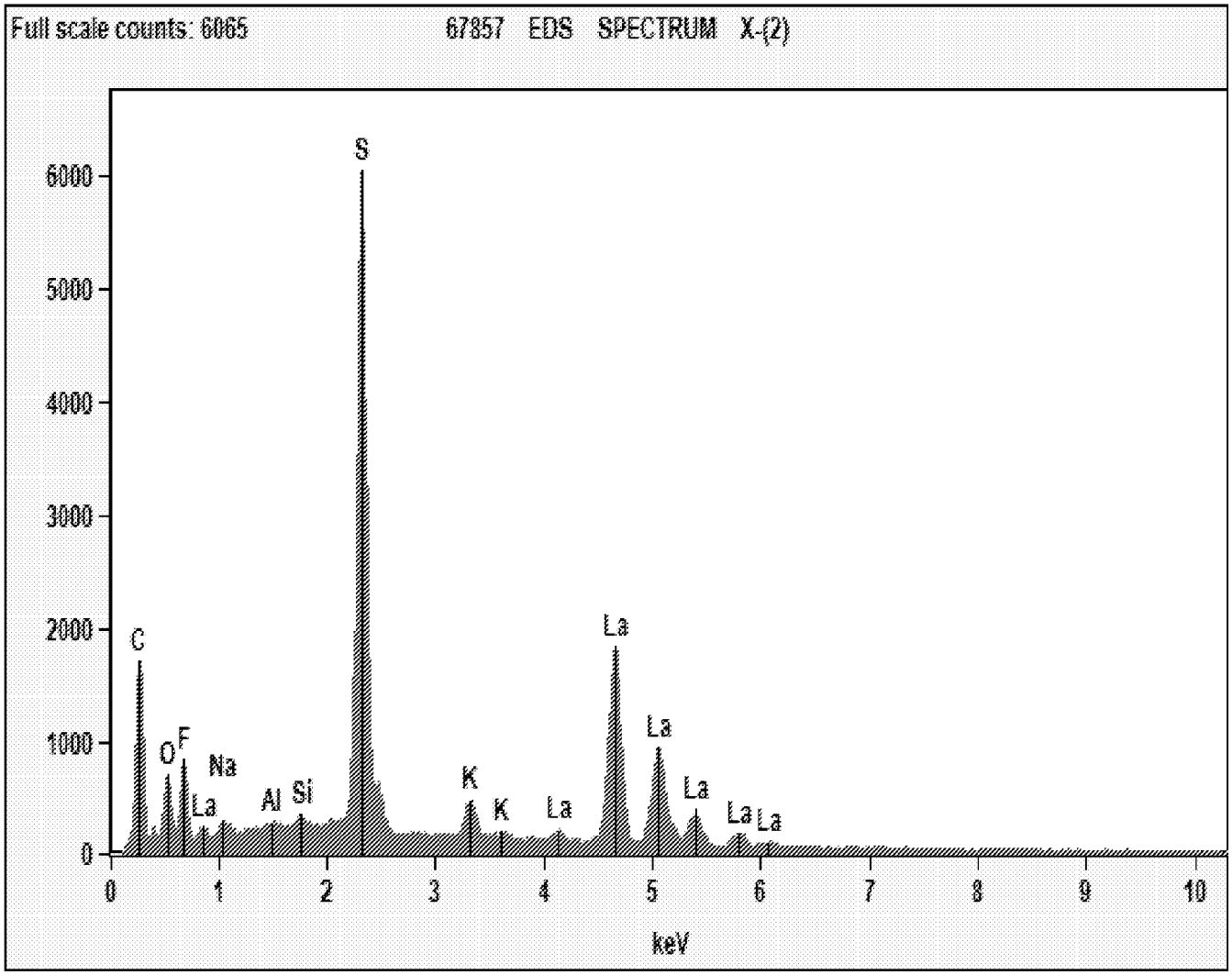
Figure 2A:
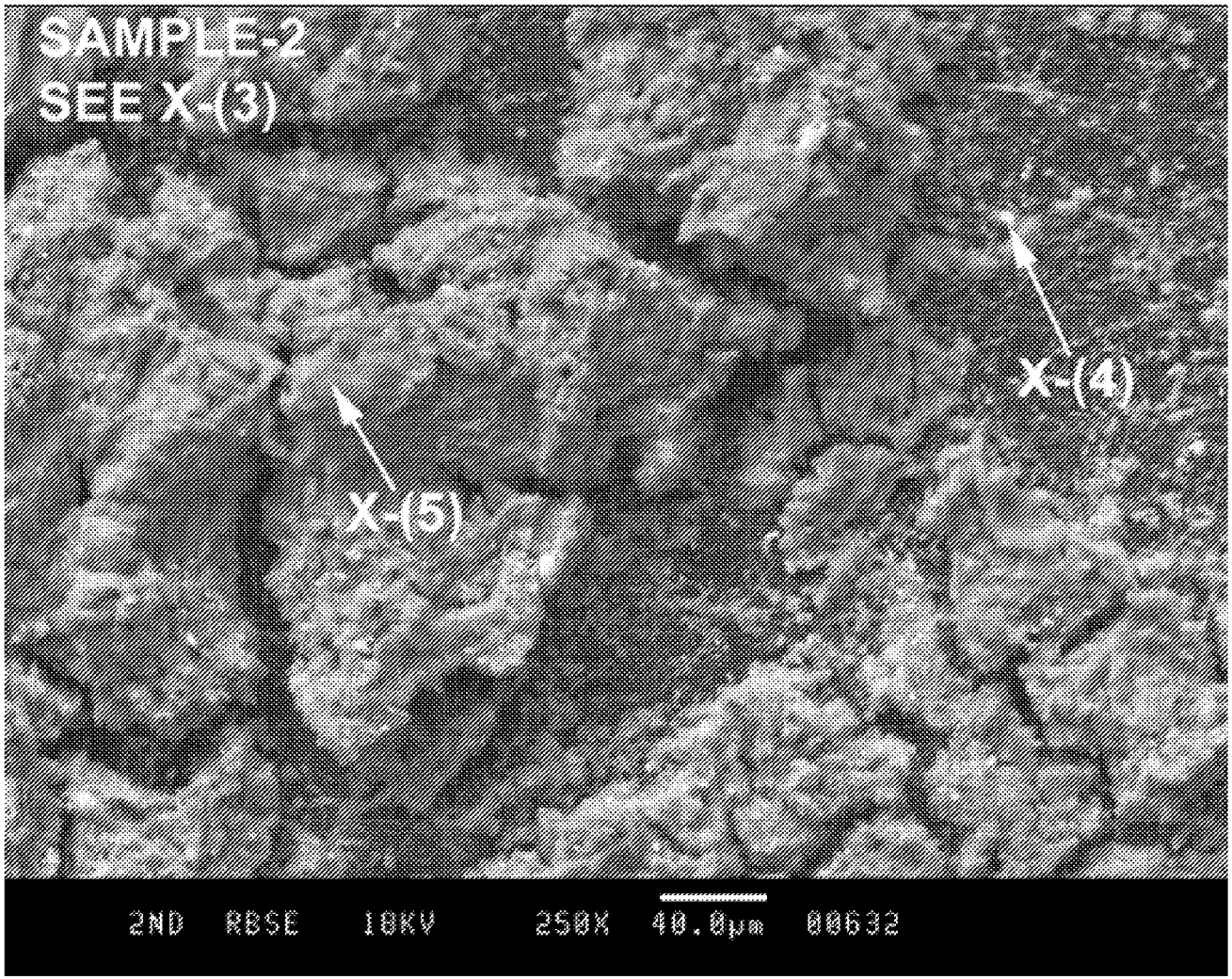
FIGS. 2A-2C depict an exemplary deposition of La at −1.9 V.
Figure 2B:
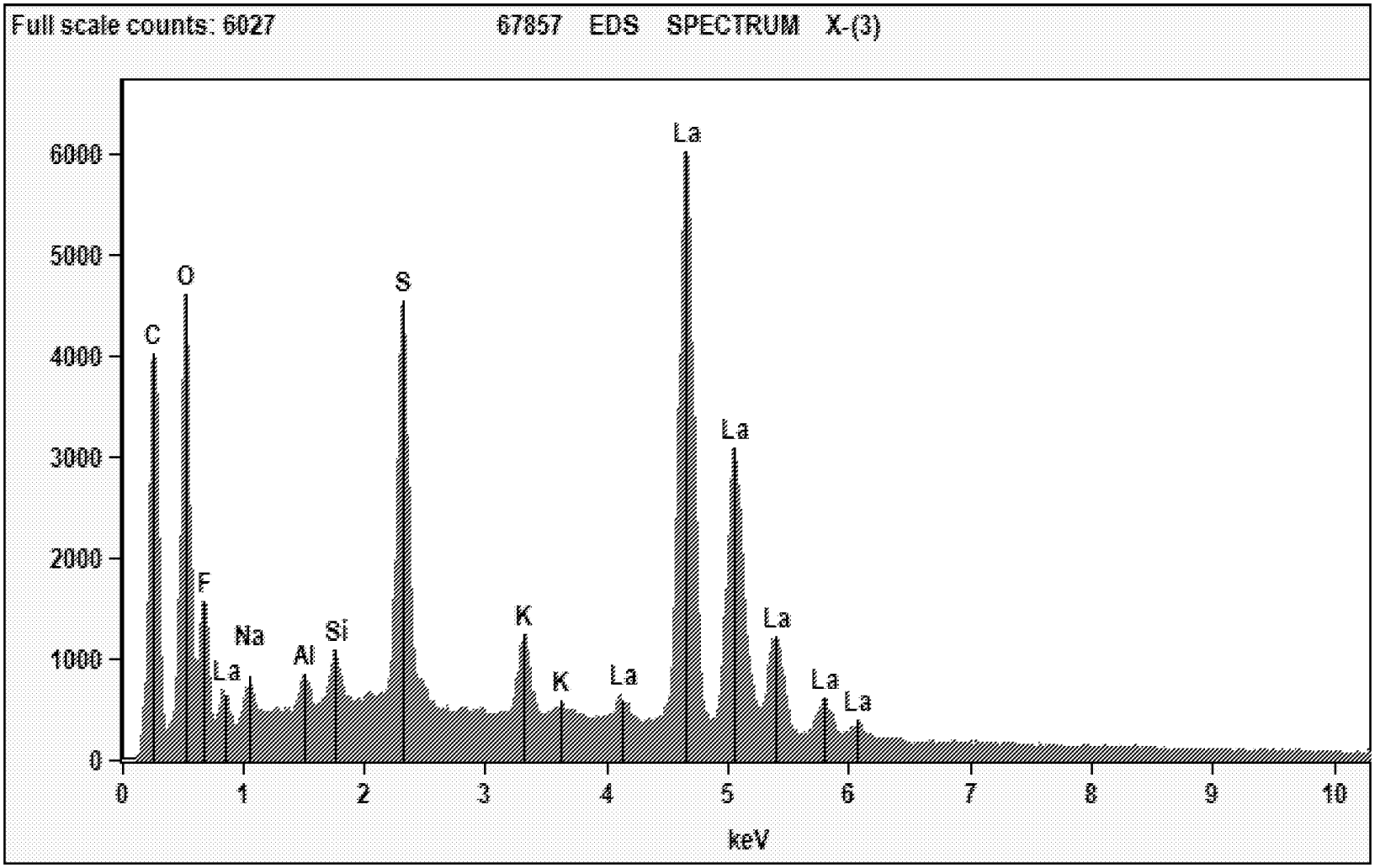
Figure 2C:
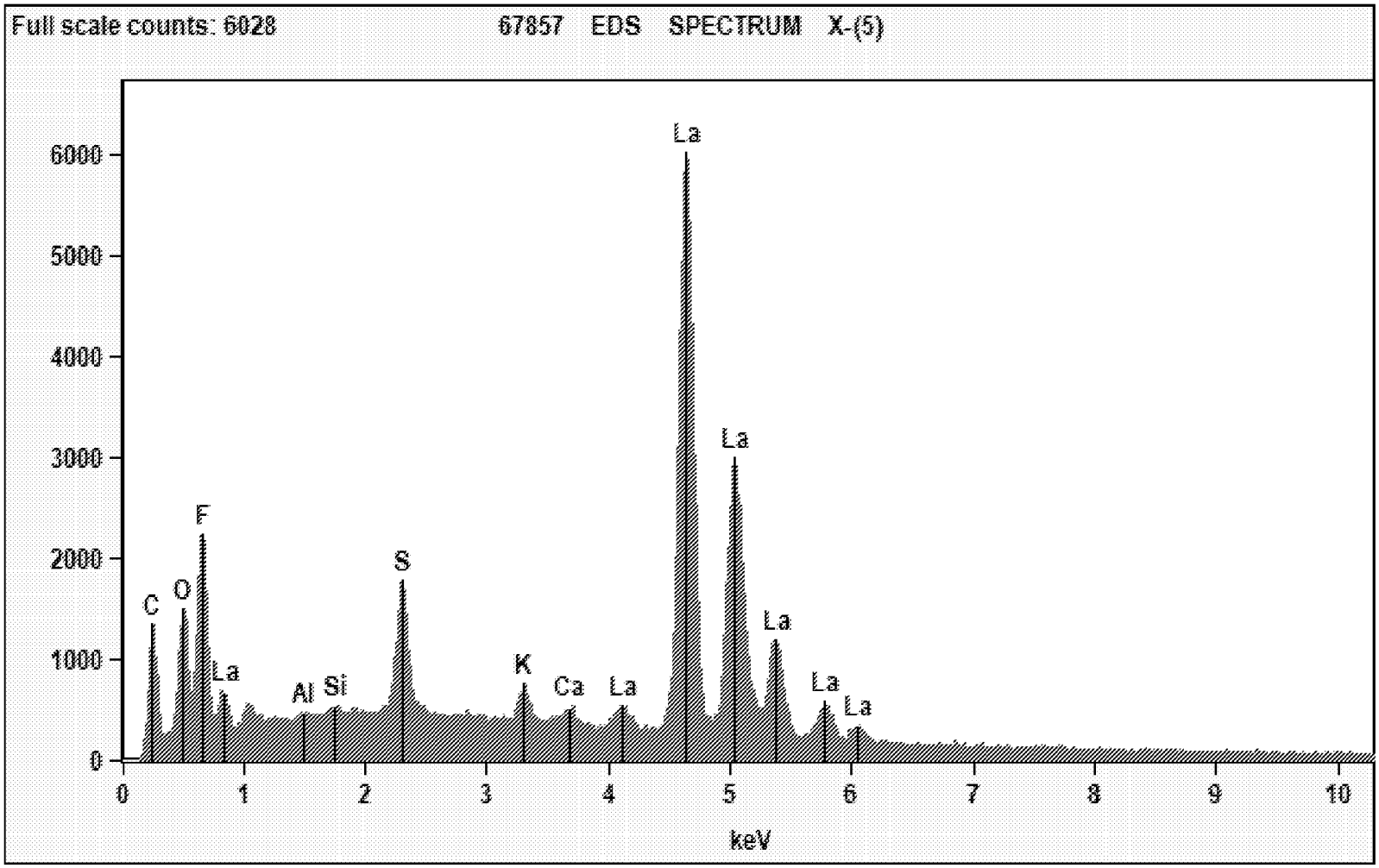
Figure 3A:
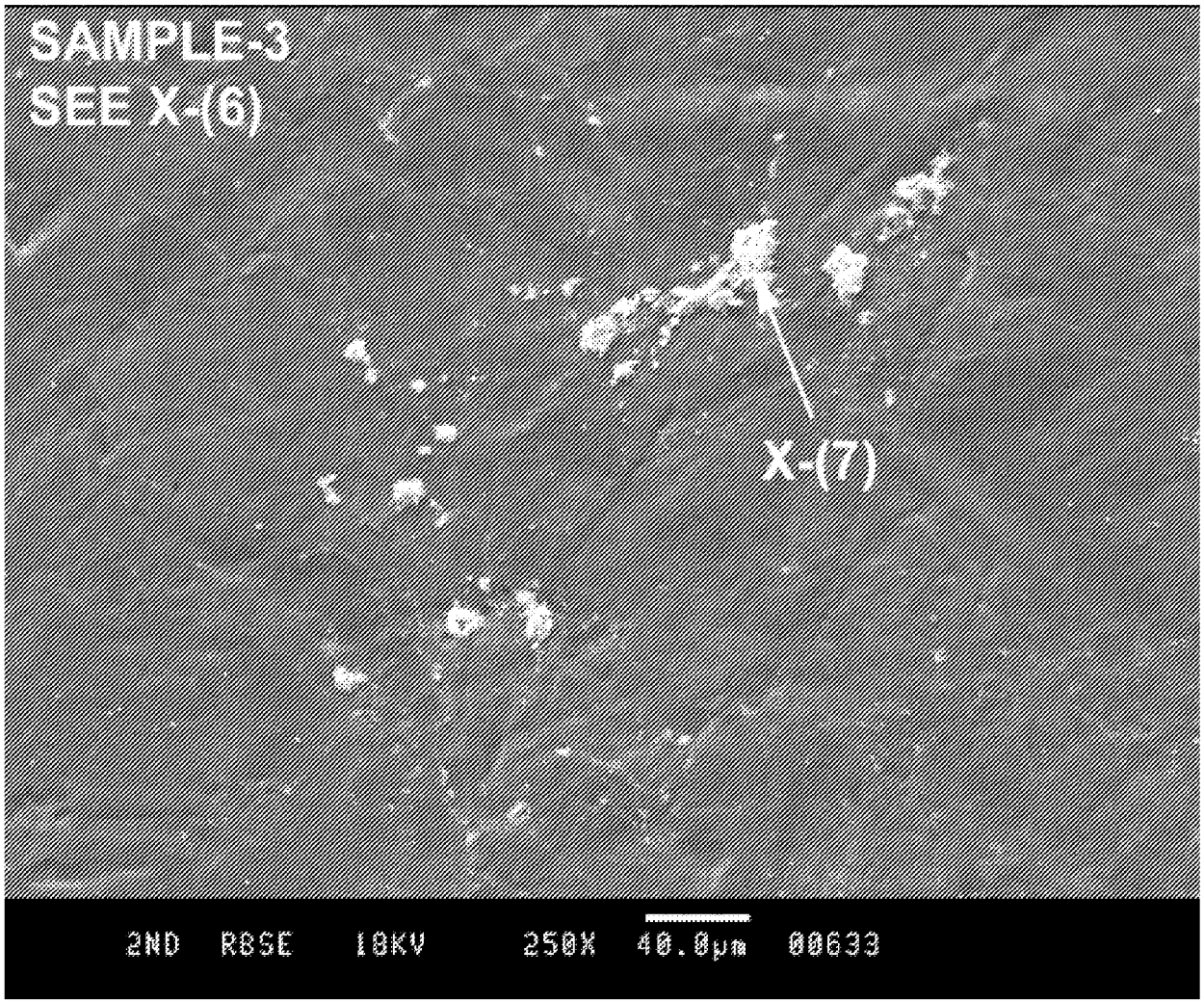
FIGS. 3A-3C depict an exemplary deposition of La at −0.57 V.
Figure 3B:
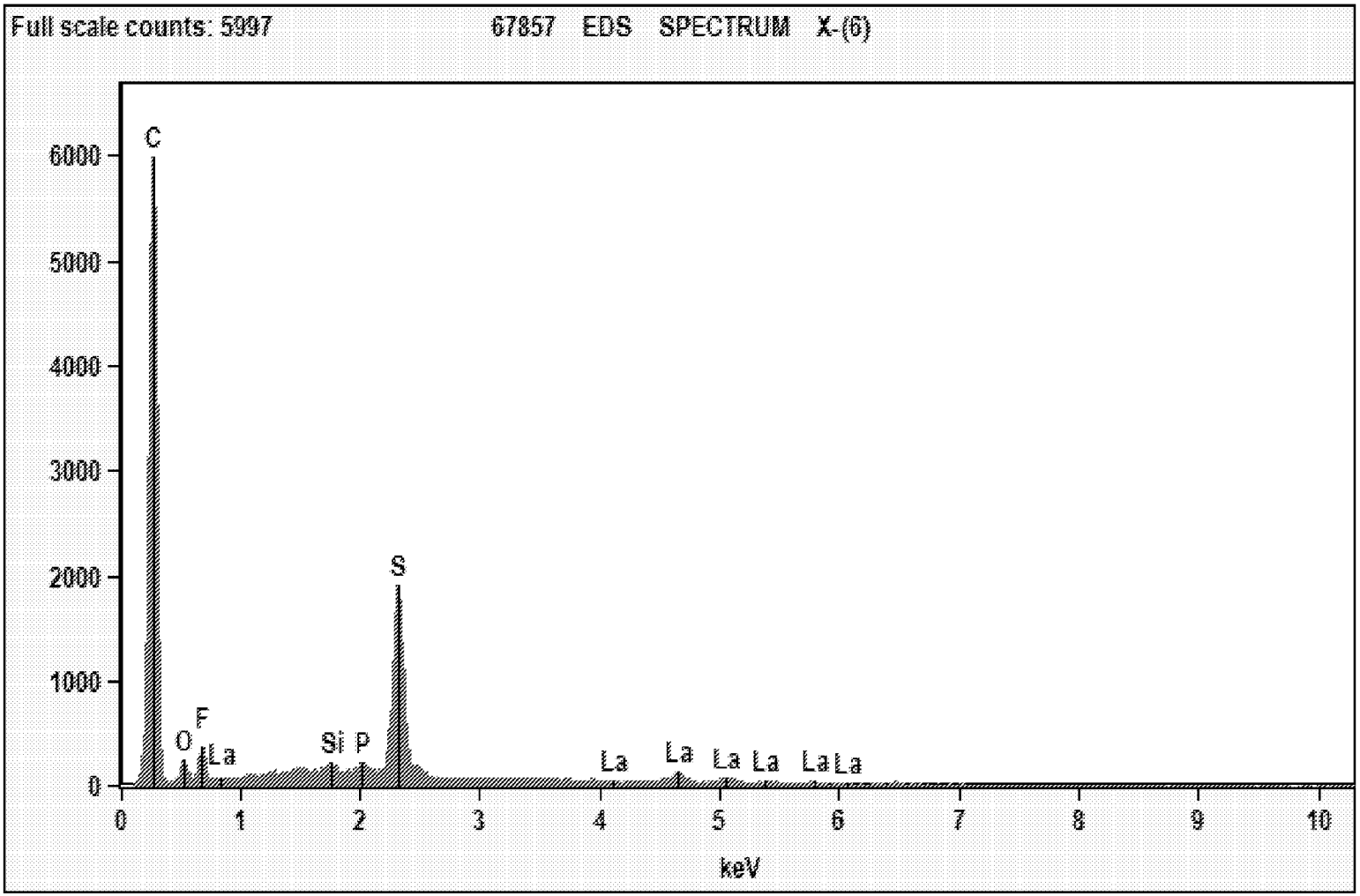
Figure 3C:
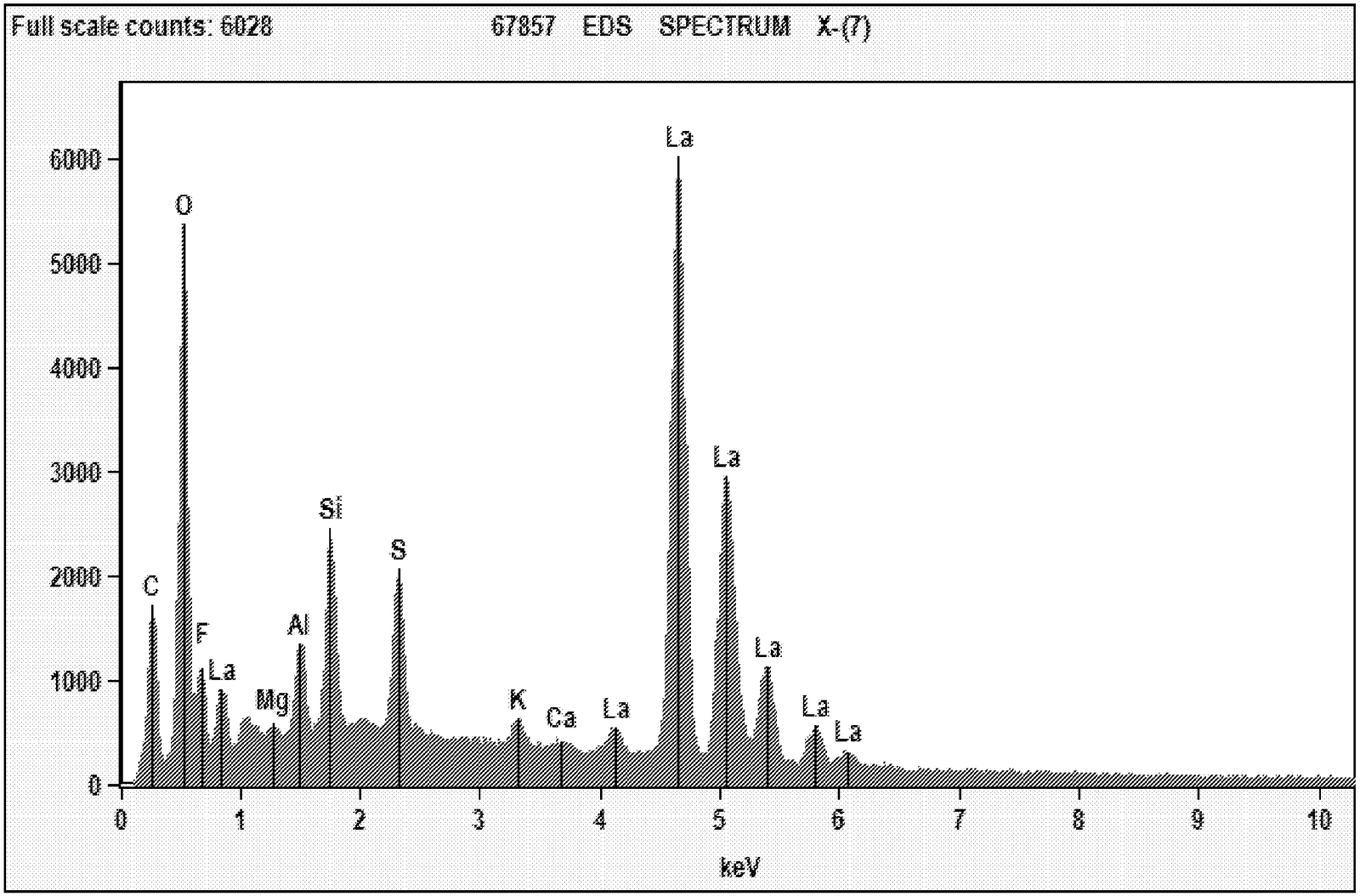

The La deposits were also examined using SEM/EDS analysis as well. FIG. 1A shows the SEM image of lanthanum deposits obtained at −2.5 V, which appears heterogeneous with a bi-modal structure. The EDS results over a broad area are shown in FIG. 1B and a definite lanthanum signal is observed. Signals from residual ionic liquid on the sample which gives rise to sulfur, oxygen, and carbon were detected. After being analyzed with a small bright spot, it was determined through EDS that it had a higher concentration of lanthanum than the bulk deposit (FIG. 2C). Similarly, the SEM/EDS data for Sample 2, La deposits obtained at an applied voltage of −1.9 V is shown in FIGS. 2A-2C. A strong signal from La is seen both in the EDS spectrum of the bulk and isolated individual spots, demonstrating successful deposition at this potential. Finally, the SEM micrograph for Sample 3 which was deposited at −0.57 V is shown in FIG. 3A. Although scant, there is evidence here that lanthanum is being deposited (FIGS. 3B and 3C). At such a low potential, this is surprising but may be due to a combination of underpotential deposition and weak ligand binding to the TFSI anion. Oxygen is seen in the EDS spectra as well, but the relative composition of lanthanum to oxygen varies greatly. If the material was entirely an oxide the EDS would change consistent with the stoichiometry of Lanthanum oxide. However, the oxygen data does not change appreciably when moved from an area of heavy or light La deposits and is consistent with signal from the IL. Therefore, the data indicates that La metal deposition is achieved.

Figure 5A:
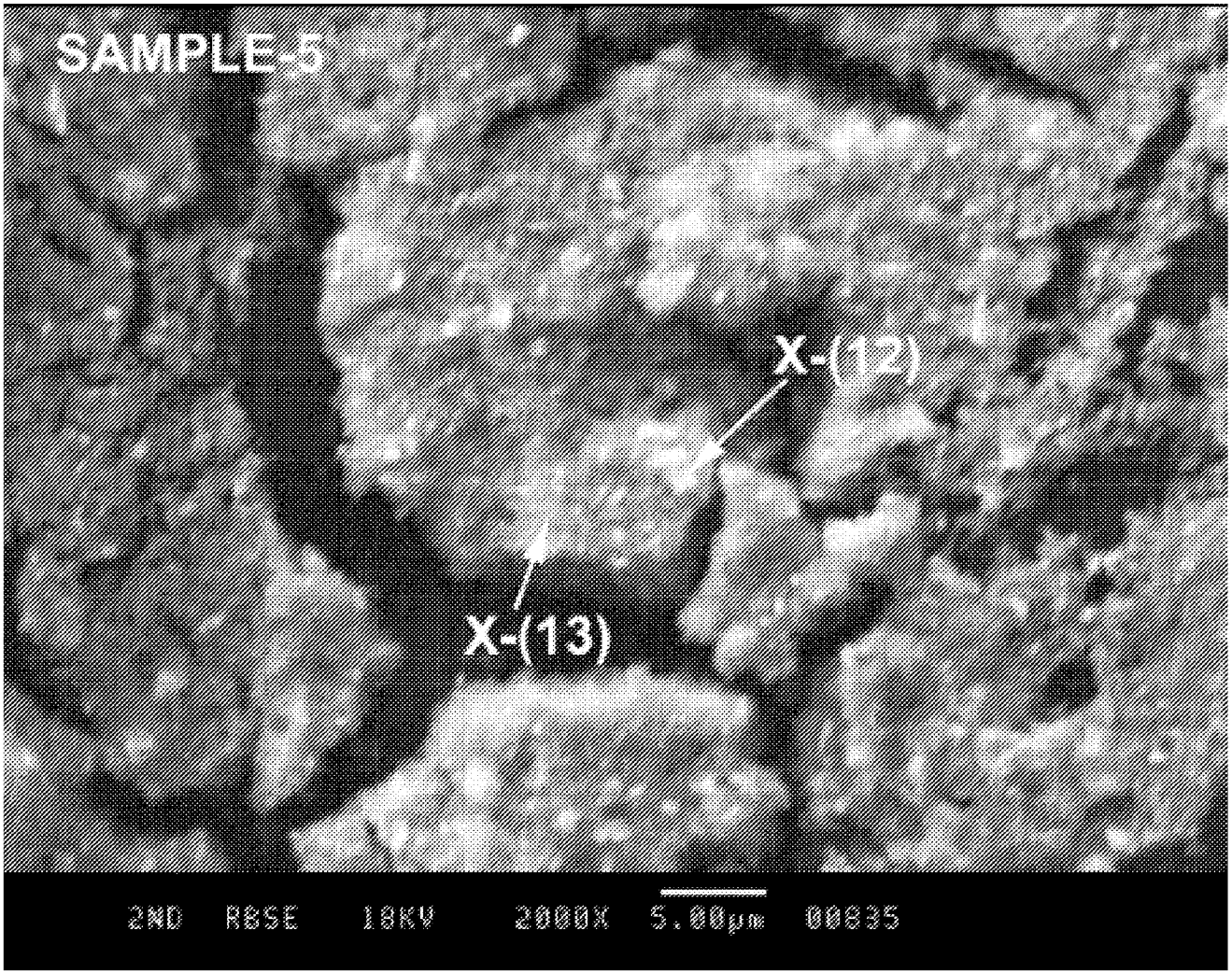
FIGS. 5A and 5B depict the deposition of La and Pr on grafoil from a binary mixture at −1.7 V.
Figure 5B:
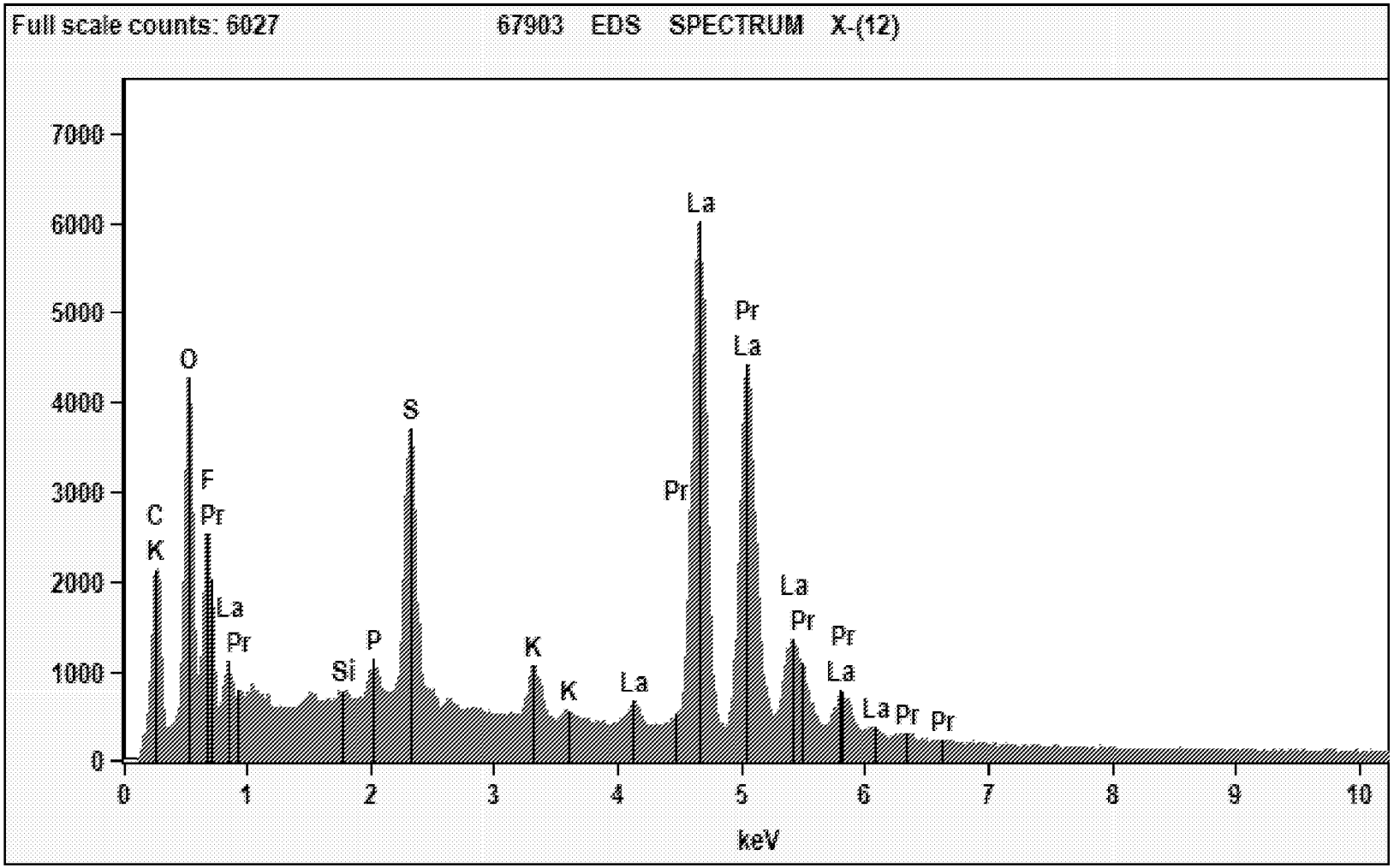

The selective deposition of rare earth species from a mixture was achieved. The applied electrochemical potential was used to preferentially deposit rare earth metals from a mixture. Different reduction potentials were used to preferentially change the composition of the deposit. The technique can be utilized to produce deposits of single species using electrochemical methods. The deposition of individual and mixed rare earth metals from precursor oxides dissolved in ionic liquids without the need for complexation with secondary species was accomplished. The applied potential was the only parameter used to achieve separation. For example the deposition from a binary mixture containing La and Pr was conducted at −1.2 and −1.7 V and the deposits were examined using SEM and EDS. The SEM image for deposits obtained at −1.7 V is provided in FIG. 5A. The EDS analysis indicates that preferential deposition of La occurs at this potential with ~80% of the total deposits associated with this species (FIG. 5B). In contrast, if the deposition potential is held at −1.2 V the composition shifts to 68% La and 32% Pr (not shown).

What is claimed is:

1. A process for recovering a rare earth element, comprising adding water and a nonaqueous acid to an ionic liquid, and dissolving an oxide of a first rare earth element directly into the ionic liquid to form an ionic solution comprising at least about 0.1 weight percent water, the acid and an ion of the first rare earth element; and applying a potential to the ionic solution to deposit the first rare earth element onto an electrode as a metal.

2. The process of claim 1, further comprising dissolving an oxide of a second rare earth element directly into the ionic liquid, wherein the ionic solution further comprises an ion of the second rare earth element, and wherein the potential applied to the ionic solution is selected to reduce the ion of the first rare earth element preferentially over the ion of the second rare earth element in the ionic solution.

3. The process of claim 1, wherein the oxide of the first rare earth element is obtained from a mined or recycled material.

4. The process of claim 2, wherein the oxide of the second rare earth element is obtained from a mined or recycled material.

5. The process of claim 1, further comprising adding the oxide of the first rare earth element to the ionic liquid prior to adding the water and the nonaqueous acid to the ionic liquid, to form a mixture of the oxide of the first rare earth element and the ionic liquid.

6. The process of claim 3, wherein the ionic solution is maintained at a temperature of 30° C. or less when the potential is applied.

7. The process of claim 1, wherein the ionic liquid comprises one or more room temperature ionic liquids.

8. The process of claim 1, wherein the ionic liquid comprises an anion selected from an n-Bis(trifluoromethanesulfonylimide) (TFSI) anion, a triflate anion, and a dicyanamide anion.

9. The process of claim 8, wherein the anion is a TFSI anion.

10. The process of claim 1, wherein the ionic liquid comprises a cation selected from a tertraalkylammonium cation, a dialkylpyrrolidinium cation, a dialkylpiperidinium cation, a tetraalkylphosphonium cation and a trialkylsulfonium cation.

11. The process of claim 10, wherein the cation is a trimethyl-n-butyl ammonium cation.

12. The process of claim 1, wherein the first rare earth element is a lanthanide.

13. The process of claim 1, wherein ionic solution is saturated with water.

14. The process of claim 1, wherein the nonaqueous acid is a solid.

15. The process of claim 8, wherein the nonaqueous acid includes a proton and an anion, and wherein the anion of the nonaqueous acid is the same as the anion of the ionic liquid.

16. The process of claim 15, wherein the nonaqueous acid is selected from n-Bis(trifluoromethanesulfonylimide) acid (HTFSI), triflic acid and dicyanamide acid.

17. The process of claim 1, wherein the ionic liquid comprises a TFSI anion and the nonaqueous acid is HTFSI.

18. The process of claim 1, further comprising neutralizing the acid in the ionic solution with an aqueous base after dissolving the oxide of the first rare earth metal directly into the ionic liquid.

19. The process of claim 1, wherein after adding water, at least some of the water is removed from the ionic liquid by degassing, by using a molecular sieve, or a combination thereof.

20. The process of claim 1, wherein the applied potential is pulsed.

21. The process of claim 1, wherein the applied potential is constant.

* * * * *